US010144632B1

(12) United States Patent
Latimer

(10) Patent No.: US 10,144,632 B1
(45) Date of Patent: Dec. 4, 2018

(54) FLOW CONTROL NOZZLE

(71) Applicant: Greg Latimer, Aumsville, OR (US)

(72) Inventor: Greg Latimer, Aumsville, OR (US)

( * ) Notice: Subject to any disclaimer, the term of this patent is extended or adjusted under 35 U.S.C. 154(b) by 0 days.

(21) Appl. No.: 15/873,808

(22) Filed: Jan. 17, 2018

Related U.S. Application Data

(60) Provisional application No. 62/515,750, filed on Jun. 6, 2017.

(51) Int. Cl.

| | |
|---|---|
| ***B67D 3/00*** | (2006.01) |
| ***B67D 7/50*** | (2010.01) |
| ***B67D 7/52*** | (2010.01) |
| ***B67D 7/44*** | (2010.01) |

(52) U.S. Cl.
CPC ..... *B67D 7/50* (2013.01); *B67D 7/44* (2013.01); *B67D 7/52* (2013.01); *B67D 2210/00128* (2013.01)

(58) Field of Classification Search
CPC .. B65D 47/061; B65D 47/248; B65D 47/283; B65D 47/32; B65D 47/20; B67D 7/44; B67D 7/52; B67D 7/50; B67D 7/005; B67D 2210/00128
USPC ..... 222/509, 513, 522–525, 514, 529; 141/335
See application file for complete search history.

(56) References Cited

U.S. PATENT DOCUMENTS

| | | | | | |
|---|---|---|---|---|---|
| 1,078,213 | A * | 11/1913 | Patnaude | B65D 83/48 | 222/514 |
| 4,356,848 | A * | 11/1982 | Spies | B65B 3/06 | 141/321 |
| 4,598,743 | A * | 7/1986 | Milling | B60K 15/04 | 141/198 |
| 4,982,881 | A * | 1/1991 | Amrein | B67D 7/0288 | 141/335 |
| 5,249,611 | A * | 10/1993 | Law | B65D 25/48 | 141/198 |
| 5,292,038 | A * | 3/1994 | Seney | B67D 1/0456 | 222/402.13 |
| 5,503,179 | A * | 4/1996 | Till | B67D 1/1455 | 134/166 C |
| 5,560,522 | A * | 10/1996 | Clark | B65D 47/20 | 141/335 |
| 8,220,671 | B2 * | 7/2012 | Gundrum | B67D 7/005 | 222/507 |
| 9,434,516 | B2 * | 9/2016 | Johnson | B67D 3/045 | |
| 9,694,954 | B2 * | 7/2017 | Lank | B65D 47/32 | |
| 2017/0297782 | A1 * | 10/2017 | Iwanejko | B65D 47/283 | |

* cited by examiner

*Primary Examiner* — Charles P Cheyney

(57) ABSTRACT

Liquid container nozzles including a valve handle, valve body, spool, and spout assembly, where the valve body may move slidingly into the valve handle over the spool to control the flow of liquid through the nozzle. Liquid flow may be controlled by adjusting the position of the valve body in relation to the valve handle and spool using varying force or pressure. The spool may include one or more holes to control the flow of liquid. In some examples of the invention, the spool may narrow in an S-shaped fashion, and the holes of the spool may be located on a portion of the spool that narrows to form S-shaped holes. These holes may swirl liquid as it is poured from the nozzle to create a more uniform flow.

8 Claims, 5 Drawing Sheets

FLOW CONTROL NOZZLE

CROSS REFERENCE TO RELATED APPLICATIONS

This application claims priority to U.S. Provisional Application No. 62/515,750, filed on Jun. 6, 2017, which is hereby incorporated by reference for all purposes.

BACKGROUND

The present disclosure relates generally to nozzles for liquid container. In particular, nozzles that control the speed and volume of flow of a liquid from a container and have the capability to seal a container are described.

Gas cans and liquid containers are an easy way to move and transport fuel and other liquids. Common types of gas cans and liquid containers have a single large storage area of the container that holds the liquid, and a single opening to pour the liquid out. Typically, liquid is poured from the single opening without further assistance or attachments, or a spout may be attached to help direct the flow of liquid from the container as it is poured. These known pouring methods are not entirely satisfactory for the range of applications in which they are employed. For example, existing spouts and container openings do not adequately control the flow of the liquid from the container. Instead, the liquid poured from the container is uncontrolled leading to spills and wasted liquid. In addition, the opening or spout on the container is not usually self-sealing, meaning the spout must be plugged or removed, and a cap placed on the opening to prevent spilling while handling the container of liquid.

Thus, there exists a need for nozzles that improve upon and advance the design of known nozzles. Examples of new and useful nozzles relevant to the needs existing in the field are discussed below.

SUMMARY

The present disclosure is directed to a liquid container nozzle that will automatically close to seal the liquid container. The nozzle may also swirl the liquid as it is poured to create a more laminar or uniform flow. The liquid container nozzle may include a hollow and tubular valve handle. The valve handle may have an exterior surface, interior surface, first end, and second end. The valve handle may be hollow with an open valve handle first end and open valve handle second end.

Further, the nozzle may have a hollow and tubular shaped valve body. The valve body may have an exterior surface, interior surface, first end, and second end. The valve body may be hollow with an open valve body first end and open valve body second end. The valve handle and the valve body are sized such that the valve body may slidingly fit within the valve handle. There may be a resistive force that is exerted as the valve body moves slidingly into the valve handle, where the force is exerted in a direction opposite of the sliding movement of the valve body.

The nozzle may further include a hollow and tubular spool that allows the flow of liquid through it. The spool may have first end that includes an opening and a second end that is closed. Further, the spool may have at least one spool hole to control and release the flow of liquid through the liquid container nozzle. The one or more spool holes are positioned on a perimeter surface of the spool and positioned substantially toward the spool second end.

The nozzle may also include a hollow and tubular spout assembly fitted at a spout first end to the valve body second end such that it is liquid tight. The spout may have a second end opposite the spout first end. A pout may be included at the spout second end to control liquid flow as liquid is passed through the liquid container nozzle.

In some examples of the invention, the liquid container nozzle may also include a compression spring. The compression spring is located in a position between the valve handle and the valve body. The compression spring provides the resistive force that is exerted as the valve body moves slidingly into the valve handle in a direction opposite of the sliding movement.

In other examples, the liquid container nozzle may also include at least one sealing ring disposed on the spool first end. The sealing ring creates a liquid tight seal between the spool and the valve body to restrict the flow of liquid through the liquid container nozzle.

In other examples, the liquid container nozzle may instead include two sealing rings. One sealing ring is disposed on the spool first end to create a liquid tight seal between the spool and the valve body to restrict the flow of liquid through the liquid container nozzle. The second sealing ring is disposed between the spool first end and spool second end on the spool's perimeter surface to create a liquid tight seal between the spool and the valve body to restrict liquid from inadvertently leaking from the liquid container nozzle. The second sealing ring is positioned and sized to allow the valve body to move slidingly over the second sealing ring while maintaining the liquid tight seal.

Still in other examples, the spool of the liquid container nozzle has a tubular shape that varies in diameter. The diameter is greater at the spool first end and narrows toward the spool second end. The spool may narrow in an S-shaped fashion. The spool hole is located on the perimeter surface at a position over where the spool narrows in an S-shaped fashion. The spool hole is shaped to swirl liquid as it passes through the liquid container nozzle to allow for a quicker, more uniform flow. In some examples, the at least one spool hole is shaped to swirl liquid as it passes through the liquid container nozzle to allow for a quicker, more uniform flow.

In other examples of the liquid container nozzle, there are two spool holes. Two spool holes are positioned on the perimeter surface of the spool at positions opposite each other at a location near the spool second end.

The liquid container nozzle may also include at least one fin disposed on the perimeter surface of the spool adjacent to the at least one hole. The fin is sized and positioned to further swirl the liquid.

The spool of the liquid container nozzle may include at least one hose barb fitting positioned around the perimeter surface at the spool first end. The hose barb fitting is sized to accept and hold a hose fitted over the spool.

The spout assembly of the liquid container nozzle may include a spout rest. The spout rest may have a C or hook shape. The spout rest may be positioned such that an opening end on the spout rest faces toward the spout second end such that the spout rest can hook onto an object as liquid is poured through the liquid container nozzle.

DETAILED DESCRIPTION

Figure 1:
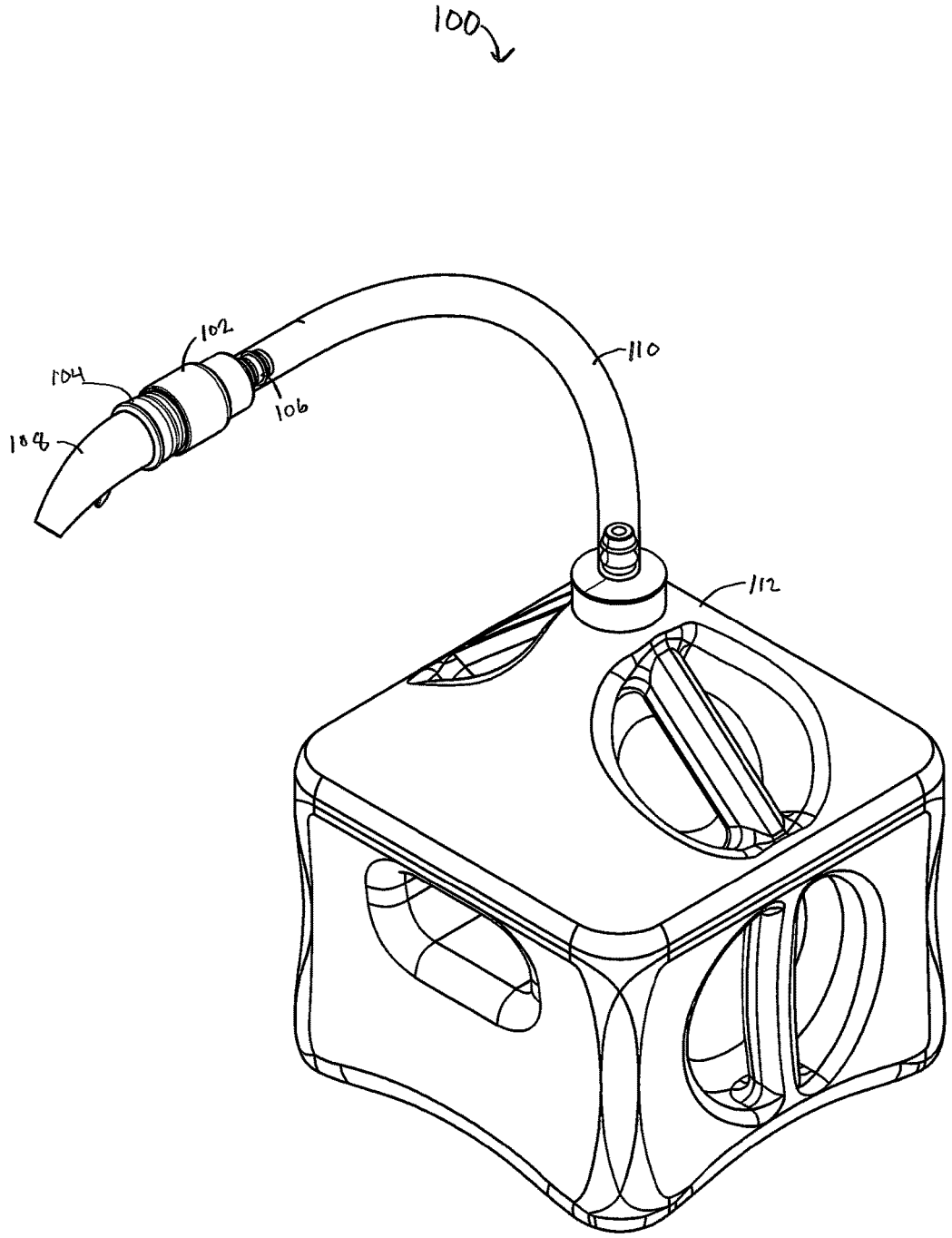
FIG. 1 is a perspective view of a first example of a flow control nozzle as potentially used with a liquid container.

The disclosed flow control nozzles will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various flow control nozzles are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-5, a first example of a flow control nozzle, nozzle 100, will now be described. Nozzle 100 functions to effectively and efficiently control the flow of liquid as it is poured from a container while additionally sealing the container after pouring to reduce the chance of a spill. The reader will appreciate from the figures and description below that nozzle 100 addresses shortcomings of conventional nozzles or spouts used with liquid containers.

For example, nozzle 100 controls the flow of liquid that can be poured from the container. Nozzle 100 may allow more or less flow with simple adjustments. Additionally, nozzle 100 may further control the flow of liquid by swirling the liquid as it pours from the container. This swirl can allow for a faster and more accurate pour. Further, after a user has finished pouring liquid from the container, nozzle 100 will automatically close and form a liquid tight seal. This makes the transportation of the container of liquid safer and more reliable without having to manually reseal the container As can be seen in FIGS. 1-5, nozzle 100 includes a valve handle 102, valve body 104, and a spool 106. In other examples, the nozzle 100 may further include a spout assembly 108 to assist in accurately pouring liquid from a container. Further, the nozzle 100 may include a hose 110 to easily connect the nozzle 100 to a liquid container and allow for maneuverability of the nozzle 100 as it is used.

As seen in FIG. 1, the hose 110 may be a flexible and hollow tube to control and direct the flow of liquid from a liquid container 112 through the hose 110, and into the nozzle 100. The hose 110 may attach to the nozzle 100 at one end, and may attached by an opposite end to the liquid container 112. The hose 110 may attach to the nozzle 100 and the liquid container 112 using any type of connection including twist on threads, snap fitting, clamps, or interference fittings like barbs. In alternate embodiments, the hose may be a rigid or semi-rigid material. Still in other embodiments of the invention, the hose may not be used, and the nozzle 100 may attach directly to the liquid container 112 using any attachment including twist on threads, snap fittings, clamps, or interference fittings.

Figure 2:
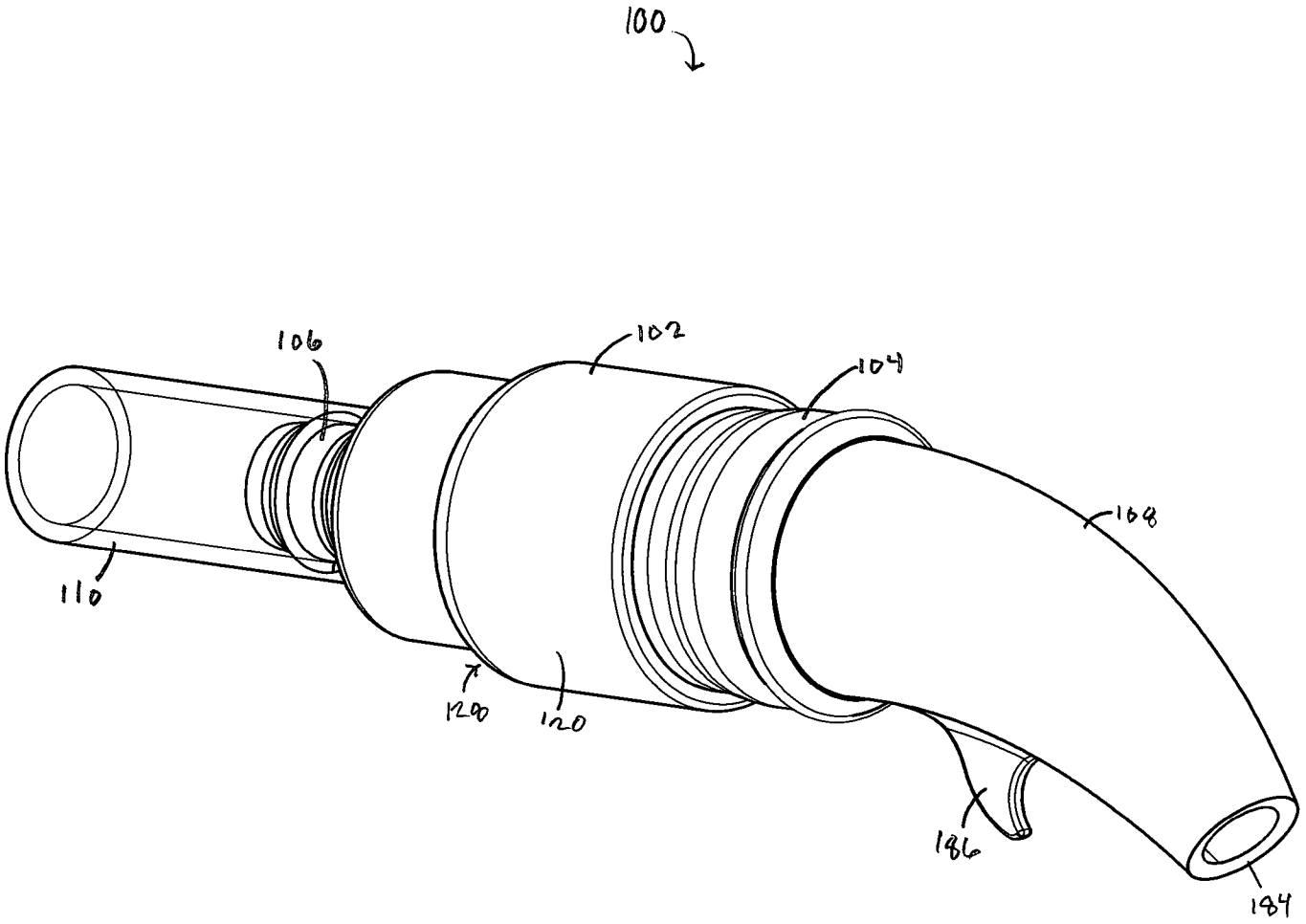
FIG. 2 is a perspective view of an assembled flow control nozzle as it attaches to a hose.
Figure 3:
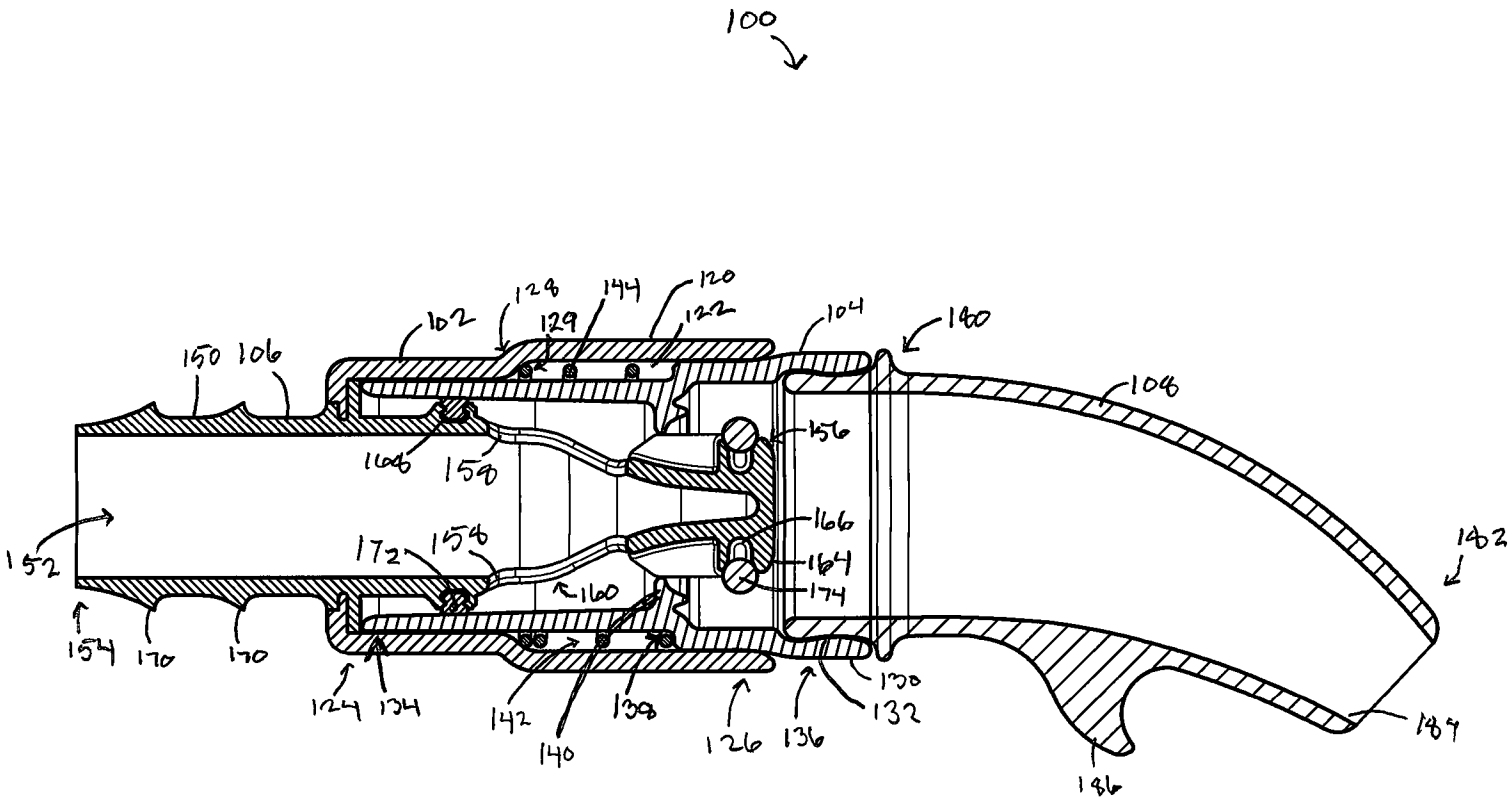
FIG. 3 is a cross sectional side view of the flow control nozzle shown in FIG. 2, depicting the nozzle in an open position.

Turning to FIG. 2, the valve handle 102 of the nozzle 100 may be tubular in shape, where the handle 102 is somewhat elongated and rounded with a hollow center. The valve handle 102 may have a valve handle exterior surface 120 that encompasses the outer perimeter of the valve handle 102. Additionally, as seen in FIG. 3, the valve handle 102 may also include a valve handle interior surface 122 on its interior that interacts with internal components as to be described. Turning back to FIG. 2, the valve handle exterior surface 120 may include a texturing to allow for increased friction so that a user may maintain a firm grasp on the valve handle 102 as the user pours liquid using the nozzle 100.

As seen in FIG. 2, the valve handle 102 may have a valve handle first end 124 and a valve handle second end 126, where the valve handle first end 124 and valve handle second end 126 are open such that the valve handle 102 creates a hollow cylindrical shape. Further, the valve handle 102 may have a variable diameter as measured across a central axis of the cylindrical shape of the valve handle 102. The variable diameter of the valve handle 102 may be of a wider diameter at one end of the valve handle 102, and narrower at the opposite end of the valve handle 102. Specifically, the diameter of the valve handle first end 124 may be narrower than the diameter of the valve handle second end 126. The change between the narrower diameter and the wider diameter may change gradually or change abruptly. In this example embodiment, the narrower valve handle first end 124 changes somewhat abruptly to the wider valve handle second end 126, and this change creates an exterior handle ridge 128, where the exterior handle ridge 128 makes a ridge shape around the valve handle 102 on the valve handle exterior surface 120. This abrupt change in diameter allows for a user to secure their grip using the exterior handle ridge 128 created by the variable diameters of the valve handle. A user may rest or press their hand or fingers against the exterior handle ridge 128 to more accurately guide the nozzle 100.

As seen in FIG. 2, the valve handle first end 124 may connect or interact with the spool 106 so as to hold it in place. Additionally, and alternatively, the valve handle first end 124 may connect directly to the hose 110 to direct the flow of liquid in to the nozzle 100. The valve handle second end 126 may be open to allow for additional components of the nozzle to move slidingly in and out of the valve handle 102. One component that may interact with the valve handle 102 is the valve body 104, where the valve body 104 moves slidingly into the valve handle 102.

Turning briefly to FIG. 3, the valve handle 102 may additionally include on its valve handle interior surface 122 an interior handle ridge 129, where the interior handle ridge 129 is a ridge, edge, or corner where the diameter changes between the valve handle first end 124 and the valve handle second end 126. The interior handle ridge 129 may allow for the interaction of other parts of the nozzle 100. More specifically, the interior handle ridge 129 may provide a location for a force or pressure to be placed against the valve handle on the valve handle interior surface 122.

As seen in FIG. 2, and also exemplified in FIG. 3, the valve body 104 may be tubular in shape, where the valve body 104 is somewhat elongated and rounded with a hollow center. The valve body 104 may have a valve body exterior surface 130 that encompasses the outer perimeter of the valve body 104. Additionally, as seen in FIG. 3, the valve body 104 may also include a valve body interior surface 132 on its interior that interacts with internal components as to be described.

As seen in FIG. 2, the valve body 104 may have a valve body first end 134 and a valve body second end 136, where the valve body first end 134 and valve body second end 136 are open such that the valve body 104 creates a hollow cylindrical shape. Further, the valve body 104 may have a variable diameter as measured across a central axis of the cylindrical shape of the valve body 104. As better exemplified in FIG. 3, the variable diameter of the valve body 104 may be of a wider diameter at one end of the valve body 104, and narrower at the opposite end of the valve body 104. In this example embodiment, the narrower valve body first end 134 changes somewhat abruptly to the wider valve body second end 136, and this change creates an exterior body ridge 138, where the exterior body ridge 138 makes a ridge or edge shape around the valve body 104 on the valve body exterior surface 130. This abrupt change in diameter allows for the valve body 104 to interact with the interior handle ridge 129 and spring.

As further exemplified in FIG. 3, the diameter of the valve body first end 134 may be narrower than the diameter of the valve body second end 136. Even more, the diameter of the valve body first end 134 may be of a diameter that is just narrower than that of the diameter of the valve handle first end 124 so that the valve body first end 134 may move slidingly into the valve handle first end 124 without too much interference and without too much of a gap between the valve body exterior surface 130 and the valve handle interior surface, such that the valve body exterior surface 130 and the valve handle interior surface 122 just touch at their respective first ends. Additionally, the diameter of the valve body second end 136 may be narrower than the diameter of the valve body second end 126, but greater than or equal to the diameter of the valve handle first end 124 such that the interior handle ridge 129 and the exterior body ridge 138 will interact with each other as the valve body 104 moves slidingly into the valve handle 102.

Further, as seen in FIG. 3, the valve body 104 may include a ridge-like protrusion on the valve body interior surface 132 around the circumference of the interior that interacts with other components to control or restrict the flow of liquid through the nozzle 100. In this example embodiment, the valve body 104 includes an interior body lip 140 around the circumference of the valve body interior surface 132. In this example embodiment, the interior body lip 140 protrudes and includes a semi-circular edge opening towards the valve body second end 136. The body lip 140 is shaped to conform to the surface of an O-ring or gasket like structure. The body lip 140 while interacting with the O-ring or gasket structure will act as a stopper, restricting the flow of liquid. If the valve body 104 moves slidingly into the valve handle 102, the interior body lip 140 will disengage the O-ring or gasket and allow the flow of liquid through the nozzle 100.

As shown in FIG. 3, between the valve body 104 and the valve handle 102 there may be a valve gap 142 that is a gap or open space between the valve handle interior surface 122 and the valve body exterior surface. 130. The valve gap 142 may additionally be characterized as a space created between the valve body's exterior body ridge 138 and the valve handle's interior dandle ridge 129. The valve gap 142 allows space to use a device to supply a resistive force between the valve handle 102 and the valve body 104 as the valve body 104 moves slidingly into the valve handle 102. In this example embodiment, a spring 144 is disposed within the area of the valve gap 142 to supply a resistive force. As the valve body moves 104 moves slidingly into the valve handle 102, the spring 144 will be compressed between the valve handle's interior handle ridge 129 and the valve body's exterior body ridge 138. As the valve handle 102 and valve body 104 move slidingly together, the spring 144 may be compressed or released to open or close the nozzle 100 and control or restrict the flow of liquid.

Figure 5:
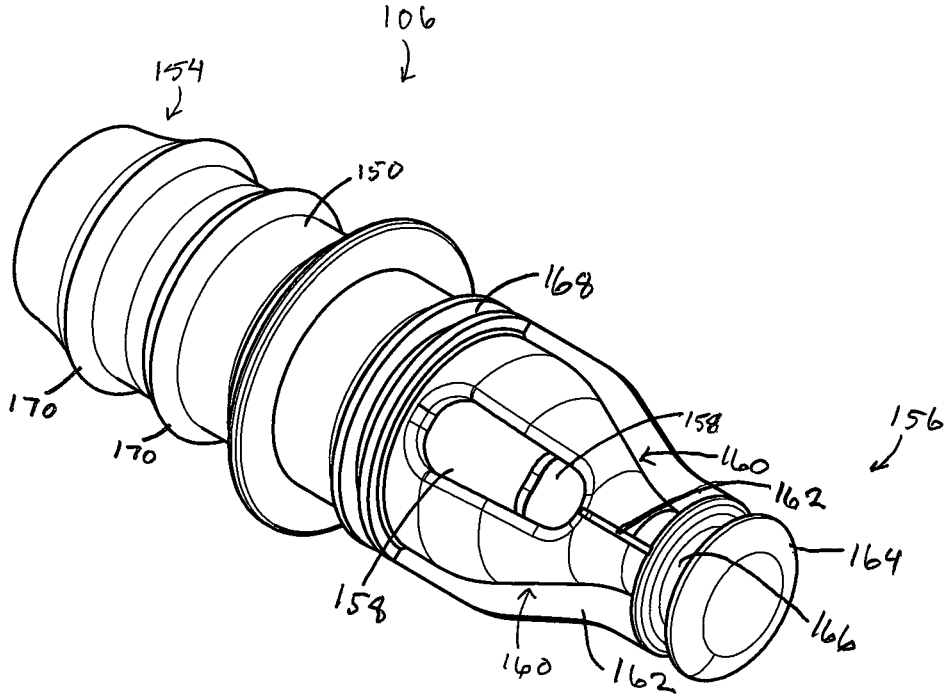
FIG. 5 is a perspective view of a spool valve used in the flow control nozzle shown in FIG. 2, depicting holes and an S-shape of the spool valve.

Further, as seen in FIG. 3, and better exemplified in FIG. 5, a spool 106 may be housed within the valve handle 102, and the valve body 104 may move slidingly over the spool 106. The spool 106 may be tubular in shape, where the spool is somewhat elongated and rounded with a hollow center. The spool 106 may have a spool exterior surface 150 that encompasses the outer perimeter of the spool 106. Additionally, as seen in FIG. 3, the spool 106 may encompass an interior spool area 152 that allows the flow of liquid through it.

As shown in FIG. 3, and exemplified in FIG. 5, the spool 106 may include one or more barbs 170 on or near the spool first end 154. The barbs 170 may be barbed or ridge-like, and may function to attach or secure the nozzle 100 to the hose 110. The barbs 170 may have a radius slightly larger than that of a radius of the spool first end 154, and are sized such that a hose or other fitting may move slidingly over the barbs 170, but create an interference fit so that friction forces hold the spool 106 tight with the hose.

As seen in FIG. 3, and exemplified in FIG. 5, the spool 106 may have a spool first end 154 and a spool second end 156 opposite the spool first end 154. In this example embodiment, the spool first end 154 is open such that it is a hollow cylindrical shape. The spool second end 156 may be closed however, and instead, the spool 106 may include one or more spool holes 158 to allow the flow of liquid through the spool 106. The spool 106 may have a variable diameter as measured across a central axis of the cylindrical shape of the spool 106. The spool may have a consistent diameter at the spool first end 154 and a tapering diameter 160 as approaching the spool second end 156. The tapering diameter 160 may be S-shaped. The diameter of the spool 106 may again be greater at the spool second end to form a spool end ridge 164. The spool end ridge 164 may include a groove 166 to hold an O-ring or gasket.

Still as seen in FIG. 3, and exemplified in FIG. 5, the one or more spool holes 158 may be located at the spool second end 156 at a point where there is a tapering diameter 160. The one or more spool holes 158 may then have a cross-sectional shape that resembles the S-shape of the tapering diameter 160. The S-shape of the spool holes 158 and the tapering diameter 160 function to allow for a more uniform flow of liquid through the nozzle 100. The tapering diameter 160 of the spool 106 allows for a greater volume of liquid to exit from the interior spool area 152 through the spool holes 158 within the valve body 104. Additionally, the S-shape of the spool holes 158 swirl the liquid as it exits the spool 106 and later the nozzle 100. The swirl of the liquid creates a more uniform flow for faster liquid flow and a more controlled pour from the nozzle 100.

As shown in FIG. 3, and exemplified in FIG. 5, further assisting the swirl and control of the flow of liquid are one or more spool fins 162. In this example embodiment, two spool fins 162 are located on the spool exterior surface 150 at the spool second end 156 between the spool hole 158 and spool end ridge 164. The spool fins 162, in addition to helping control the flow of liquid, may also act as a guide for the valve body 104 as the valve body 104 moves slidingly over the spool 106. In this example embodiment, the interior body lip 140 of the valve body 104 may contact or slide along an edge of the spool fin 162 to help guide the interior body lip 140 toward the spool second end 156 and spool end ridge 164.

As shown in FIG. 3, the nozzle 100 may further include one or more sealing rings, O-rings or gaskets to control the flow of liquid and make the nozzle 100 liquid tight. In this example embodiment, there may be a first sealing ring 172 located around a perimeter of the spool 106 inside the valve body 104. The first sealing ring 172 may be set into a second groove 168 embedder in or on the perimeter of the spool 106 on the spool exterior surface 150 to resist movement in relation to the spool 106. The first sealing ring 172 allows for a liquid tight seal between the spool 106 and the valve body 104, while allowing the valve body 104 to move slidingly past the spool 106 and in contact with the first sealing ring 172.

Additionally, as seen in FIG. 3, the nozzle 100 may include a second sealing ring located at or near the spool second end 156. The second sealing ring 174 may sit in the groove 166 at the spool second end 156. In this example embodiment, the second sealing ring 174 engages and disengages with the interior body lip 140 to create a liquid tight seal when they are engaged and touching, or to allow liquid to flow past when the nozzle 100 is in an open position and the second sealing ring 174 and interior body lip 140 are disengaged and not touching.

As shown in FIG. 2, and better exemplified in FIG. 3, the nozzle 100 may further include a spout assembly 108 to help direct and control the flow of liquid from the nozzle. The spout assembly 108 may be hollow and tubular in shape and substantially open at its ends to allow for liquid to flow through it. The spout assembly 108 may include a spout first end 180 and a spout second end 182 opposite the spout first end 180. The spout first end 180 may attach to the valve body second end 136 and create a liquid tight seal. In this example embodiment, the spout first end 180 is fitted into the valve body second end 136 by interference fitting, where the spout first end 180 fits tightly into the valve body second end 136. In other examples, the spout first end 180 may fit over the valve body second end 136, or it may attach using other means including threading, snap fittings, thermal welding, glue, or other means. Still in other examples, the nozzle 100 does not include the spout assembly 108 at all.

As shown, the spout assembly 108 may also include a location to accurately pour liquid from the nozzle 100. In this example embodiment, the spout assembly 108 includes a pour 184 located at the spout second end 182. The pour 184 is a narrowing portion of the spout assembly 108 at the spout second end 182 such that the spout assembly 108 resembles a funnel shape. The pour 184 is a narrowing area to more accurately guide liquid being poured from the nozzle 100 into either another container or tank. In some example embodiments, the pour 184 may slightly bend in a direction off center. This directional bending may contribute to more accurately pouring liquid from the container by directing the liquid in a predetermined direction. In this example embodiment, the pout 184 bends in a slight downward direction.

Located on the spout assembly 108, as shown in FIGS. 2 and 3, a spout rest 186 may protrude from the spout assembly 108. The spout rest 186 may be a protrusion, notch, or catch to assist in the pouring of liquid from the nozzle 100. In this example embodiment, the spout rest 186 may be a fin-like protrusion from a side of the spout assembly 108, where the fin-like protrusion includes a C-shaped side. The C-shaped side of the fin-like protrusion of the spout rest 186 may open toward the spout second end 182. This orientation allows the spout rest 186 to catch or hold on to a lip or edge of a container or tank as the nozzle tips upward to allow liquid to flow through it. Additionally, the spout rest 186 provides a point of contact to push on, where a force may be exerted on the spout rest 186 in a direction substantially parallel to the axis of the nozzle 100 and valve handle 102 to push the spout assembly 108 and valve body 104 inward into the valve handle 102 and over the spool 106. Alternatively, there may not be a spout rest, and force may be applied to the spout assembly 108 or the valve body 104 directly.

The nozzle 100 allows for a user to control the speed and flow of liquid from a container, and automatically seal the container when not in use to prevent spilling of liquid, especially during transportation of the liquid. As can be seen in a comparison between FIG. 3 and FIG. 4, the nozzle may alternate between an open position as exemplified by FIG. 3, and a closed position as exemplified in FIG. 4. When in the open position as shown in FIG. 3, liquid would be free to flow from a container through the nozzle 100, and out the spout assembly 108 into a container or tank. When in the closed position, as shown in FIG. 4, the nozzle 100 would automatically close and create a liquid tight seal, restricting the flow of liquid through the nozzle 100 reducing spills and leakage from the container.

Turning specifically to FIG. 3, when in the open position, liquid will be able to flow through the nozzle 100. To be in an open position, a force may be applied to the valve body 104 in a direction that would push the valve body 104 slidingly into the valve handle 102 over the spool 106. This would typically be done by applying a pressure to the spout rest 186. As the valve body 104 moves into the valve handle 102 and over the spool 106, a spring 144 is compressed to supply a resistive force against the movement. The valve body 104 may move slidingly over the first sealing ring 172 without disengaging it to keep a liquid tight seal to prevent liquid from spilling from the nozzle. As the valve body 104 moves, the interior body lip 140 will disengage from the second sealing ring 174 to create a gap or opening in the nozzle 100 to allow liquid to flow through it. The interior body lip 140 may continue to move slidingly, being guided by the spool fins 162.

As seen in FIG. 3, first, liquid could flow from the hose 110 into the spool 106. The liquid would flow through the spool 106 and through the one or more S-shaped spool holes 158, which will swirl the liquid creating a funnel effect. The liquid will then flow past the one or more spool fins 162 which direct the liquid toward an open end of the nozzle. Because the interior body lip 140 is disengaged from the second sealing ring 174 when in an open position as shown in FIG. 3, the liquid is free to flow past the interior body lip 140 and second sealing ring 174 and into the spout assembly 108. Once in the spout assembly 108, the liquid will flow toward the spout second end 182 and directed out the pour 184.

Figure 4:
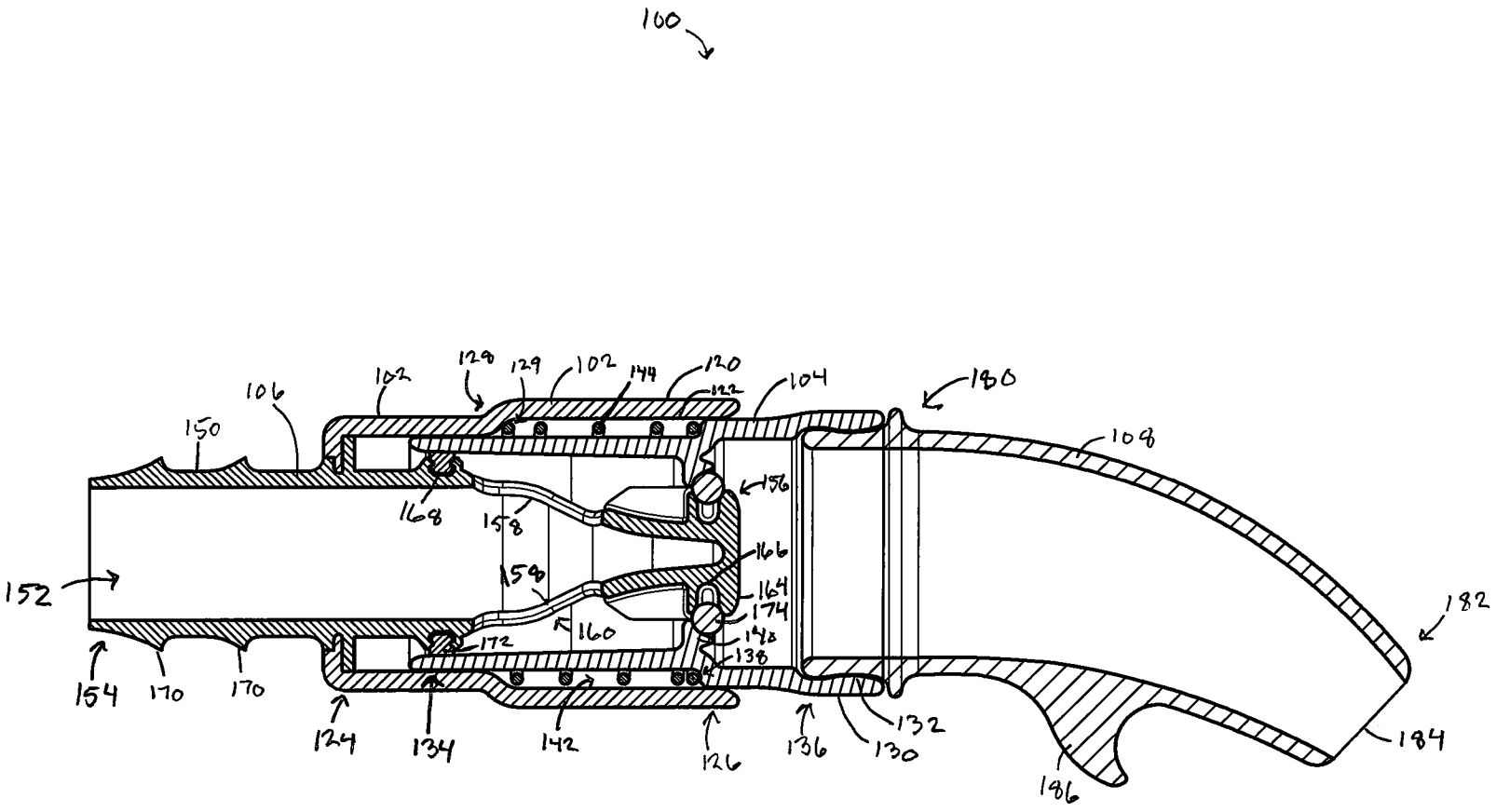
FIG. 4 is a cross sectional side view of the flow control nozzle shown in FIG. 2, depicting the nozzle in a closed position.

Now turning to FIG. 4, after pouring the liquid, nozzle 100 will automatically revert to a closed position as the force or pressure is released holding it open, and liquid will not be able to flow through the nozzle 100. In order for the nozzle 100 to automatically close and seal, the force or pressure pushing on the valve body 104 should be released. The spring 144 which has been applying a resistive force to the movement of the valve body 104 now acts to push the valve body 104 in a direction outward from the valve handle 102. As the valve body 104 moves outward, the first sealing ring 172 continues to engage the valve body 104 to prevent leaking as the valve body 104 moves slidingly out of the valve handle 102. The spool fins 162 may guide the interior body lip 140 into a position where the interior body lip 140 engages with the second sealing ring 174. Once the interior body lip 140 engages with the second sealing ring 174, movement of the valve body 104 stops, and the spring 144 continues to apply a force to keep the interior body lip 140 engaged with the second sealing ring 174.

Now that the interior body lip 140 is engaged with the second sealing ring 174 and held in place by the spring 144, the nozzle 100 is considered to be in the closed position. When in the closed position, liquid could flow from the hose 110 into the spool 106 and through the one or more spool holes 158. However, because the interior body lip 140 is engaged with the second sealing ring 174, liquid will be restricted from flowing further past the interior body lip 140 and second sealing ring 174 at the spool second end 156. This effectively seals the nozzle 100 and container, and prevents spilling or leakage from either the container or nozzle 100.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A liquid container nozzle, comprising:

a valve handle, wherein the valve handle is a hollow and tubular shape, with a valve handle exterior surface, valve handle interior surface, valve handle first end, and valve handle second end, and wherein the valve handle is hollow with an open valve handle first end and open valve handle second end;

a valve body, wherein the valve body is a hollow and tubular shape, with a valve body exterior surface, valve body interior surface, valve body first end, and valve body second end, and wherein the valve body is hollow with an open valve body first end and open valve body second end; wherein the valve handle and the valve body are sized such that the valve body may slidingly fit within the valve handle; and wherein there is a resistive force that is exerted as the valve body moves slidingly into the valve handle, where the force is exerted in a direction opposite of the sliding movement of the valve body; and a spool, wherein the spool is a hollow and tubular shape that varies in diameter and allows the flow of liquid through it, the spool having a spool first end that includes an opening, and a spool second end that is closed, and where the diameter is greater at the spool first end and narrows toward the spool second end in an S-shaped fashion, the spool further comprising;

at least one spool hole to control and release the flow of liquid through the liquid container nozzle, wherein the at least one spool hole is positioned on a perimeter surface of the spool and is positioned substantially toward the spool second end, wherein the at least one spool hole is located on the perimeter surface at a position over where the spool narrows in an S-shaped fashion, wherein the spool hole is shaped to swirl liquid as it passes through the liquid container nozzle to allow for a quicker, more uniform flow; and at least one fin disposed on the perimeter surface of the spool adjacent to the at least one hole, wherein the at least one fin is sized and positioned to further swirl the liquid; and a spout assembly, wherein the spout assembly is hollow and tubular and is fitted at a spout first end to the valve body second end such that it is liquid tight, and a spout second end opposite the spout first end, and wherein the spout assembly includes a pour at a spout second end to control liquid flow as liquid is passed through the liquid container nozzle.

2. The liquid container nozzle of claim 1, further comprising;

a compression spring, wherein the compression spring is located in a position between the valve handle and the valve body, wherein the compression spring provides the resistive force that is exerted as the valve body moves slidingly into the valve handle in a direction opposite of the sliding movement.

3. The liquid container nozzle of claim 1, further comprising;

at least one sealing ring disposed on the spool first end, and where the sealing ring creates a liquid tight seal between the spool and the valve body to restrict the flow of liquid through the liquid container nozzle.

4. The liquid container nozzle of claim 1, further comprising;

two sealing rings, wherein one sealing ring is disposed on the spool first end to create a liquid tight seal between the spool and the valve body to restrict the flow of liquid through the liquid container nozzle, and wherein the second sealing ring is disposed between the spool first end and spool second end on the spool's perimeter surface to create a liquid tight seal between the spool and the valve body to restrict liquid from inadvertently leaking from the liquid container nozzle, and wherein the second sealing ring is positioned and sized to allow the valve body to move slidingly over the second sealing ring while maintaining the liquid tight seal.

5. The liquid container nozzle of claim 1, wherein the at least one spool hole is shaped to swirl liquid as it passes through the liquid container nozzle to allow for a quicker, more uniform flow.

6. The liquid container nozzle of claim 1, wherein the at least one spool hole is comprised of two spool holes, wherein the two spool holes are positioned on the perimeter surface of the spool at positions opposite each other at a location near the spool second end.

7. The liquid container nozzle of claim 1, wherein the spool further comprises;

at least one hose barb fitting positioned around the perimeter surface at the spool first end, the at least one hose barb fitting sized to accept and hold a hose fitted over the spool.

8. The liquid container nozzle of claim 1, wherein the spout assembly further comprises;

a spout rest, the spout rest being having a C or hook shape, and positioned such that an opening end on the spout rest faces toward the spout second end such that the spout rest can hook onto an object as liquid is poured through the liquid container nozzle.

* * * * *